US010993052B2

(12) United States Patent
El-Hoiydi

(10) Patent No.: US 10,993,052 B2
(45) Date of Patent: Apr. 27, 2021

(54) SELECTING AUDIO INPUT FROM A HEARING DEVICE AND A MOBILE DEVICE

(71) Applicant: Sonova AG, Staefa (CH)

(72) Inventor: Amre El-Hoiydi, Neuchatel (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/513,798

(22) Filed: Jul. 17, 2019

(65) Prior Publication Data

US 2020/0029160 A1 Jan. 23, 2020

(30) Foreign Application Priority Data

Jul. 23, 2018 (GB) ..... 1811962

(51) Int. Cl.
*H04R 25/00* (2006.01)

(52) U.S. Cl.
CPC ..... *H04R 25/554* (2013.01); *H04R 25/505* (2013.01); *H04R 25/602* (2013.01); *H04R 25/604* (2013.01); *H04R 2225/55* (2013.01)

(58) Field of Classification Search
CPC ..... H04R 25/43; H04R 25/554
See application file for complete search history.

(56) References Cited

U.S. PATENT DOCUMENTS 5,721,783 A * 2/1998 Anderson ..... H04B 1/385 381/328
7,593,537 B2 * 9/2009 Enzmann ..... H04R 25/43 381/312
9,065,929 B2 * 6/2015 Chen ..... H04M 1/72591
9,071,916 B2 * 6/2015 Chapero-Rueda ..... H04M 1/2474
9,510,083 B2 11/2016 Schobel et al.
9,769,858 B2 9/2017 Seymour et al.
(Continued)

FOREIGN PATENT DOCUMENTS

EP 2 882 203 A1 12/2013
EP 3 101 910 A1 12/2016
(Continued)

OTHER PUBLICATIONS

UK Intellectual Property Office, Combined Search and Examination Report under Sections 17 and 18(3), dated Jan. 24, 2019, 5 pages, Concept House, Cardiff Road, Newport, South Wales, NP10 8QQ.

*Primary Examiner* — Ryan Robinson

(57) ABSTRACT

A method for selecting audio input from a microphone of a hearing device or a microphone of a mobile device comprising: detecting proximity between the hearing device and the mobile device. If proximity between the hearing device and the mobile device is detected, receiving an audio input with the microphone of the mobile device and generating a mobile device audio signal from the audio input; transmitting the mobile device audio signal from the mobile device into a communication network. If proximity between the hearing device and the mobile device is not detected, the method comprises: receiving an audio input with the microphone of the hearing device and generating the hearing device audio signal from the audio input with the hearing device; transmitting the hearing device audio signal from the hearing device to the mobile device; transmitting the hearing device audio signal from the mobile device into a communication network.

19 Claims, 2 Drawing Sheets

(56) References Cited

U.S. PATENT DOCUMENTS

| | | | | |
|---|---|---|---|---|
| 10,341,786 | B2 * | 7/2019 | Pedersen | H04R 25/43 |
| 10,681,756 | B2 * | 6/2020 | Kihlberg | H04W 8/005 |
| 2002/0076073 | A1 * | 6/2002 | Taenzer | H04R 25/502<br>381/315 |
| 2008/0165994 | A1 * | 7/2008 | Caren | H04R 25/554<br>381/312 |
| 2012/0082329 | A1 * | 4/2012 | Neumeyer | H04R 25/50<br>381/314 |
| 2012/0330600 | A1 * | 12/2012 | Kuo | H04B 17/27<br>702/150 |
| 2016/0295376 | A1 * | 10/2016 | Geng | H04W 4/33 |
| 2017/0164123 | A1 * | 6/2017 | Aubreville | H04R 25/407 |
| 2017/0311092 | A1 * | 10/2017 | Secall | H04R 25/505 |

FOREIGN PATENT DOCUMENTS

| | | | |
|---|---|---|---|
| WO | WO 2008/071807 | A2 | 3/2008 |
| WO | WO 2010/039437 | A1 | 9/2009 |
| WO | WO 2010/108492 | A1 | 9/2010 |
| WO | WO 2014/197737 | A1 | 12/2014 |

* cited by examiner

SELECTING AUDIO INPUT FROM A HEARING DEVICE AND A MOBILE DEVICE

FIELD OF TECHNOLOGY

The disclosed technology relates to a method, a computer program and a computer-readable medium for selecting audio input from a microphone of a hearing device and a microphone of a mobile device. Furthermore, the disclosed technology relates to a hearing system with a hearing device and a mobile device.

BACKGROUND

Hearing devices are generally small and complex devices. Hearing devices can include a processor, microphone, speaker, memory, housing, and other electronical and mechanical components. Some example hearing devices are Behind-The-Ear (BTE), Receiver-In-Canal (RIC), In-The-Ear (ITE), Completely-In-Canal (CIC), and Invisible-In-The-Canal (IIC) devices. A user can prefer one of these hearing devices compared to another device based on hearing loss, aesthetic preferences, lifestyle needs, and budget.

A hearing device may comprise a microphone and a loudspeaker, wherein audio input at the microphone may be frequency dependent filtered and/or amplified for compensating the hearing loss. The modified audio signal is then output by the loudspeaker, which may be located near or in the ear of the user.

A mobile phone may be a portable device, which may be used for performing telephone calls, which may be transmitted via a cellular radio communication network. Also a mobile phone may comprise a microphone and a loudspeaker. The audio signal at the microphone is transmitted via the radio communication network to another person, which, for example, also may use a mobile phone. The audio signal of the other person then may be transmitted back to the first person and may be put out by the loudspeaker.

A person, which is not hearing impaired, typically uses a mobile phone either with the built-in microphone and loudspeaker, or completely via a BLUETOOTH headset. When a BLUETOOTH headset is used, a voice pickup may be done at the headset, using a directional microphone pointing to the mouth or using a boom microphone.

Hearing impaired persons may need to receive the incoming audio signal directly in their hearing devices. Some hearing devices include a BLUETOOTH headset function with a voice pickup at the hearing device, a wireless transmission of outgoing audio to the mobile phone, and a wireless reception of incoming audio. However, under some circumstances, it may be more beneficial to perform voice pick up at the mobile phone.

The following publications and patents discussed technology for using a mobile phone. WO 2014 197 737 A1 is about a method to detect that a phone is in a car and to automatically switch from a text based user interface towards an audio user interface allowing hands-free interactions. WO 2010 039 437 A1 is about a method to select the best from several microphones on a telephone such as to obtain the best voice signal-to-noise ratio. U.S. Pat. No. 9,510,083 B2 describes a method to automatically manage the connection between one headset and two devices, such as a smartphone and a laptop. U.S. Pat. No. 9,769,858 B2 is about transferring pairing with a hearing device peripheral among several devices. EP 3 101 910 A1 is about controlling which one, from several devices, shall send audio to a pair of wireless earbuds. U.S. Pat. No. 9,065,929 B2 describes proximity detection between a hearing device and a mobile phone based on magnetic fields.

Accordingly, there exists a need for solving the above-identified problems as well as providing additional benefits.

SUMMARY

It is an objective of the disclosed technology to support a hearing device user in using a mobile device. It is a further objective of the disclosed technology to improve the signal-to-noise ratio in a phone call, which is performed by a hearing device user.

These objectives are achieved by the subject-matter of the independent claims. Further exemplary embodiments are evident from the dependent claims and the following description.

A first aspect of the disclosed technology relates to a method for selecting audio input from a microphone of a hearing device worn by a user and a microphone of a mobile device.

As already mentioned, a hearing device may be a device worn by a user in and/or behind the ear, which may have a microphone near and/or in the ear channel and a loudspeaker in the ear channel. Furthermore, a hearing device may be a hearing aid and/or may be adapted for compensating a hearing loss of the user by frequency dependent amplifying an audio signal, for example receiving it from the microphone and/or, for example, putting it out by the loudspeaker. It has to be noted that the audio signal also may be put out with a cochlear implant and not only with a loudspeaker.

A housing of the hearing device may be designed to be worn behind the ear and/or in the ear. Furthermore, a hearing device microphone and optionally a hearing device loudspeaker may be provided in the hearing device housing.

A mobile device may be a device, which may have a microphone and a loudspeaker and/or which may be used for performing telephone calls. A mobile device may be a mobile phone and/or a smartphone. A housing of the hearing device may be designed to be portable. Furthermore, a mobile device microphone and a mobile device loudspeaker may be provided in the mobile device housing.

According to an embodiment of the disclosed technology, the method comprises: detecting proximity between the hearing device and the mobile device. In general, for detecting proximity, it may be determined, whether a distance of the hearing device and the mobile device is smaller than a distance threshold. If proximity is detected and/or if the distance is smaller than the distance threshold, a mobile device audio signal may be selected, otherwise a hearing device audio signal may be selected.

If proximity is not detected, the method comprises: receiving an audio input with the microphone of the hearing device and generating the hearing device audio signal from the audio input with the hearing device; transmitting the hearing device audio signal from the hearing device to the mobile device; and transmitting the hearing device audio signal from the mobile device into a communication network.

If proximity is detected, the method comprises: receiving an audio input with the microphone of the mobile device and generating a mobile device audio signal from the audio input with the mobile device; and transmitting the mobile device audio signal from the mobile device into the mobile communication network.

In both cases, the selected audio signal is transmitted from the mobile device into the communication network. The mobile device may communicate with the communication network via radio communication. The communication network may be a mobile communication network, for example a cellular network handing over communication between cells. The method may be performed, when the hearing device is in a telephone mode. The telephone mode may be started, when the user initiates/performs a telephone call with the mobile device. The telephone mode may be ended, when the telephone call ends. The method may be used for telephony, i.e. when the user of the hearing device is additionally using a mobile device for performing a telephone call.

The selected audio signal may be transmitted via the communication network to a far-end user, which also may have a phone.

The method may be seen as a method to automatically select the best suited microphone among the hearing device microphone and the mobile device microphone. With the method, it may be reacted automatically to an action done by the hearing device user, which action may comprise speaking into the microphone of the mobile device in noisy conditions.

It is assumed that it is beneficial to enable either the microphone of the hearing device or the microphone of the mobile device based on proximity detection. Proximity detection may be to decide, whether a distance of the hearing device and the mobile device is smaller than a threshold. With the method, a user of the hearing device may perform a telephone call hands-free in low noise conditions and also may have a good signal-to-noise ratio in noisy conditions. Furthermore, a switching between both microphones may be done automatically. In noisy condition, a user may move the mobile device next to the head to automatically trigger the selection of the mobile device audio signal.

With the method, an audio input, such as the voice of the user, is received by the microphone of the hearing device and with the microphone of the mobile device. Proximity between the mobile device and the hearing device may be detected, to enable a voice pickup at the phone when proximity is detected, and to enable voice pickup at the hearing device when proximity is not detected. The audio input is then transformed into an audio signal, which may be a digital signal, with either the mobile device or the hearing device. The audio signal then may be output by the hearing device.

Proximity detection and/or the decision, whether a distance of the hearing device and the mobile device is smaller than a threshold, may be determined by determining the distance between the hearing device and the mobile device and comparing it with a distance threshold.

It may be determined, whether the mobile device is in proximity of the hearing device or not. Proximity detection may be performed on the hearing device and/or the mobile device and/or may be based on measurements and/or signals, which depend on a distance of the mobile device and the hearing device.

A proximity sensor may be adapted to sense electric, electromagnetic and/or magnetic fields generated by the mobile device or the hearing device. However, a proximity sensor for proximity detection may be based on other measurement types, such as loudness and/or light strength, i.e. the proximity sensor also may be based on sound and/or light.

One possibility would be to use a magnetic sensor and/or magnetometer as proximity sensor. The magnetic sensor may be adapted to sense the strength of a magnetic field generated by the mobile device and/or the hearing device. For example, proximity detection on the hearing device may be implemented using a magnetic sensor, detecting a magnetic field produced by the phone speaker.

According to an embodiment of the disclosed technology, proximity detection is based on a signal of a sensor of the mobile device and/or is performed by the mobile device. Proximity may be detected at the mobile device side via a proximity sensor, such as a magnetic sensor as described above. It also may be possible that a radio receiver of the mobile device is used as proximity sensor and that a received signal strength (RSSI) measurement of the radio signal received at the radio receiver of the mobile device is used for proximity determination.

According to an embodiment of the disclosed technology, proximity detection is based on a signal of a sensor of the hearing device and/or is performed by the hearing device. Proximity may be detected at the hearing device side via a proximity sensor, such as a magnetic sensor as described above. It also may be possible that a radio receiver of the hearing device is used as proximity sensor and that an RSSI measurement of the radio signal received at the radio receiver of the hearing device is used for proximity determination.

According to an embodiment of the disclosed technology, proximity between the hearing device and the mobile device is detected from a received signal strength and/or a signal strength loss of a radio transmission link between the mobile device and the hearing device. The radio transmission link may be used to transmit data between the mobile device and the hearing device. Data may be exchanged between the hearing device and the mobile device, for example via BLUETOOTH. This data also may contain an audio signal, for example from the hearing device and/or from the mobile device.

RSSI measurements may be based on already existing protocols of the radio transmission link. In particular, BLUETOOTH Classic RSSI measurement and/or BLUETOOTH low energy protocol RSSI measurement may be used. These protocols may offer information of the signal strength of the radio transmission at the sender (such as the hearing device and the mobile device) and/or at the receiver (such as the hearing device and the mobile device). Additionally or alternatively, information on a signal strength loss between the sender and the receiver may be offered by the protocol.

According to an embodiment of the disclosed technology, proximity detection may be performed by comparing the signal strength of the radio transmission and/or signal strength loss of the radio transmission with a threshold. A signal strength loss may be determined from a received signal strength by subtracting the received signal strength from a sent signal strength. The sent signal strength also may be determined and/or may be assumed to have a specific value.

According to an embodiment of the disclosed technology, a current received signal strength is determined and a moving average is determined from the current received signal strength. The decisions, whether the distance is smaller than a threshold, may be determined by comparing the moving average with a threshold. The received signal strength may be continuously determined and a moving average over a past time window may be calculated. This may balance measurement imprecisions and/or may balance movements of the user.

According to an embodiment of the disclosed technology, a maximal received signal strength is monitored and the threshold is determined from the maximal received signal strength. An actual maximal received signal strength may be determined for a past time window. Since the received signal strength may be maximum when the user is holding the mobile device at the ear, determining the maximal received signal strength may be used to calibrate the proximity detection algorithm when the absolute transmit power is unknown. It may be assumed that the threshold is a specific percentage of the maximal received signal strength and/or may be determined by subtracting a specific value from the maximal received signal strength.

According to an embodiment of the disclosed technology, the threshold is determined from a table of thresholds with a type of the mobile device, wherein the table contains thresholds for a plurality of types of mobile devices. One possibility is that suitable thresholds are determined for a plurality of mobile devices and stored in a table. The threshold for comparing then may be determined by determining the type of mobile device, which may be less complicated than determining a maximal received signal strength.

According to an embodiment of the disclosed technology, the method further comprises: determining a signal-to-noise ratio of the hearing device audio signal. Such a signal-to-noise ratio may be determined by (solely) analysing the hearing device audio signal. The mobile device audio signal then may be selected, if the distance is smaller than a threshold and the signal-to-noise ratio of the hearing device signal is smaller than a (second) threshold. In other words, switching to the mobile device microphone may be done only, if proximity is detected and if the signal-to-noise ratio at the hearing device is bad.

It also may be possible to monitor the signal-to-noise ratio of both the mobile device audio signal and the hearing device audio signal and to decide to use the audio signal with the better signal-to-noise ratio. For example, this may be performed by the mobile device. Also in this case, switching to the mobile device microphone may be done only, if proximity is additionally detected.

According to an embodiment of the disclosed technology, the user has two hearing devices and each hearing device has a microphone. Usually, a user may have a hearing device behind each ear. Each hearing device may have a housing of its own, in which housing a microphone and optionally a loudspeaker is arranged.

In this case, the hearing device audio signal may be generated from an audio input of the microphones of the hearing devices, i.e. the hearing device audio signal may comprise information on both audio signals.

It has to be noted that proximity detection may be done with an RSSI and/or sensor measurements of both hearing devices. The proximity detection may be done for every hearing device (as described above and below) and proximity may be detected, when this is the case for one of the hearing devices. It may be decided, that a distance of the hearing device and the mobile device is smaller than a threshold, when a distance of one of the hearing devices and the mobile device is smaller than a threshold.

According to an embodiment of the disclosed technology, the method further comprises: outputting the selected audio signal with the hearing device to a user of the hearing device. The voice of the user captured with the mobile device or with the hearing device may be added to a received audio signal, which may be received from the communication network and/or from a phone of a far end user. In such a way, the user of the mobile device can hear himself. If the selected audio signal is output by the hearing device, this may be called a side tone.

According to an embodiment of the disclosed technology, the method further comprises: processing the selected audio signal by the hearing device to compensate for a hearing deficiency of the user of the hearing device. In particular, the audio signal may be generated by the mobile device from the audio input at the microphone of the mobile device, may be transmitted to the hearing device and may be processed by the hearing device. An audio signal received from the communication network and/or a side tone may be processed to compensate for hearing losses.

It has to be noted that an audio signal, which is transmitted from the mobile device to the hearing device, which may have been received by the mobile device from the communication network also may be processed by the hearing device to compensate for a hearing deficiency of the user of the hearing device. The audio signal from the communication network may be added to the audio signal generated from the microphone of the hearing device.

According to an embodiment of the disclosed technology, the method further comprises: transmitting, when the mobile device audio signal is selected, the mobile device audio signal to the hearing device via a radio transmission link, and/or transmitting, when the hearing device audio signal is selected, the hearing device audio signal to the mobile device via a radio transmission link. As already mentioned, the radio transmission link may be based on BLUETOOTH.

Further aspects of the disclosed technology relate to a computer program for selecting audio input from a microphone of a hearing device and a microphone of a mobile device, which, when being executed by a processor, is adapted to carry out the steps of the method as described in the above and in the following as well as to a computer-readable medium, in which such a computer program is stored.

For example, the computer program may be executed in a processor of a hearing device, which hearing device, for example, may be carried by the person behind the ear. The computer-readable medium may be a memory of this hearing device. The computer program also may be executed by a processor of the mobile device and the computer-readable medium may be a memory of the mobile device. It also may be that steps of the method are performed by the hearing device and other steps of the method are performed by the mobile device.

In general, a computer-readable medium may be a floppy disk, a hard disk, an USB (Universal Serial Bus) storage device, a RAM (Random Access Memory), a ROM (Read Only Memory), an EPROM (Erasable Programmable Read Only Memory) or a FLASH memory. A computer-readable medium may also be a data communication network, e.g. the Internet, which allows downloading a program code. The computer-readable medium may be a non-transitory or transitory medium.

A further aspect of the disclosed technology relates to a hearing system comprising a hearing device and/or a mobile device, wherein the hearing system is adapted for performing the method as described in the above and in the following. The hearing system may be seen as a wireless telephony system comprising a mobile device and at least one ear-worn hearing device worn by a user. The microphone of the mobile device may be used to capture the user's voice, if proximity between the mobile device and at least one of the ear-worn devices is detected. Furthermore, the microphone(s) of the ear-worn device(s) may be used to capture the user's voice if proximity between the mobile device and the ear-worn device(s) is not detected.

It has to be understood that features of the method as described in the above and in the following may be features of the computer program, the computer-readable medium and the hearing system as described in the above and in the following, and vice versa.

These and other aspects of the disclosed technology will be apparent from and elucidated with reference to the embodiments described hereinafter.

BRIEF DESCRIPTION OF THE DRAWINGS

Below, embodiments of the present disclosed technology are described in more detail with reference to the attached drawings.

The reference symbols used in the drawings, and their meanings, are listed in summary form in the list of reference symbols. In principle, identical parts are provided with the same reference symbols in the figures.

DETAILED DESCRIPTION

Figure 1:
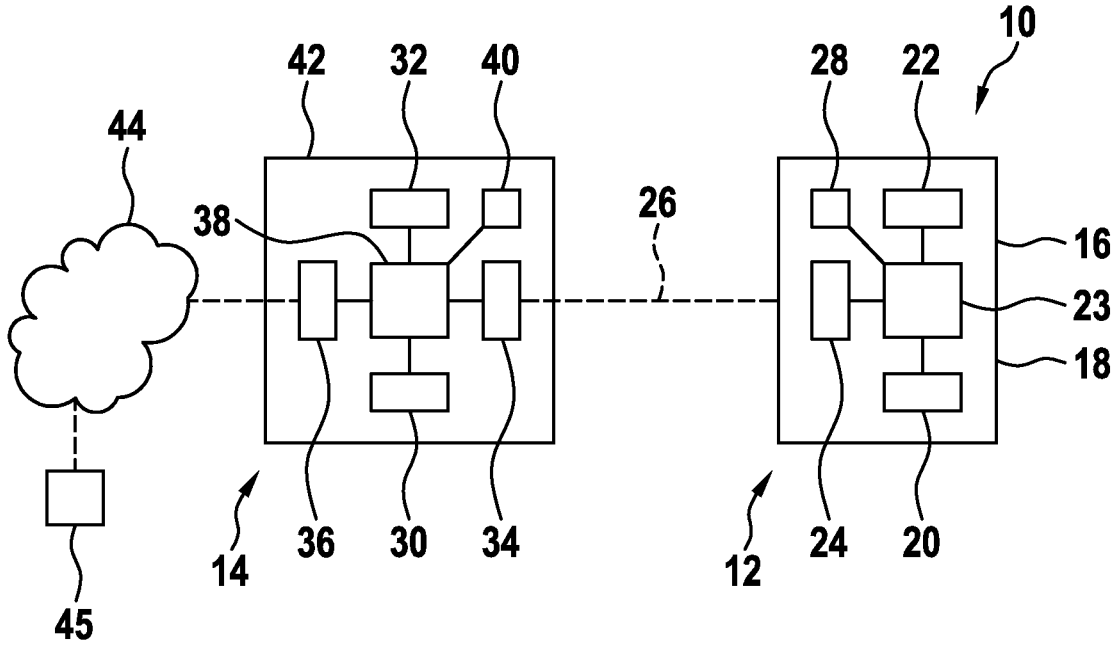
FIG. 1 schematically shows a hearing system according to an embodiment of the disclosed technology.

FIG. 1 shows a functional diagram of a hearing system 10 comprising a pair 12 of hearing devices 16 and a mobile device 14, such as a mobile phone.

Each of the hearing devices 16 has a housing 18, which a user of the hearing device 12 may wear behind on one of his ears. Each hearing device 16 comprises a microphone 20, a loudspeaker 22 and a processor 23 for generating an audio signal from audio input into the loudspeaker 22 and/or for processing the audio signal to compensate for a hearing loss of the user. The processed audio signal then may be put out with the loudspeaker 22.

The hearing device 16 further comprises a sender/receiver 24 to communicate via a radio transmission link 26 with the mobile device 14. The sender/receiver 24 may be a BLUETOOTH sender/receiver. The communication via the radio transmission link 26 may be performed via a BLUETOOTH protocol and/or one or more specific BLUETOOTH profiles, such as BLUETOOTH classic, BLUETOOTH low energy, BLUETOOTH Classic HFP (Hands-Free Profile), etc.

Furthermore, the hearing device 16 may comprise a proximity sensor 28, which is adapted for determining, whether the hearing device 16 and the mobile device 14 are in proximity or not. For example, the proximity sensor 28 may comprise a magnetic sensor and/or magnetometer for sensing a magnetic field generated by the mobile device 14.

The microphone 20, the loudspeaker 22, the processor 23, the sender/receiver 24 and the optional proximity sensor 28 all may be accommodated in the housing 18.

The mobile device 14, for example a so called smartphone, comprises a microphone 30, a loudspeaker 32, a first sender/receiver 34, a second sender/receiver 36 and a processor 38. The mobile device 14 furthermore may optionally comprise a proximity sensor 40. The components 30, 32, 34, 36 and 38 as well as the optional proximity sensor 40 all may be accommodated in a housing 42 of the mobile device 14.

With the first sender/receiver 34, the mobile device 14 may establish communication via the radio transmission link 26 with the hearing device 16. As the sender/receiver 24, the sender/receiver 34 may be a BLUETOOTH sender/receiver and the communication may be performed via BLUETOOTH and/or one or more BLUETOOTH profiles.

With the second sender/receiver 36, the mobile device 14 may establish communication with a communication network 44, for example to a further phone 45. The communication network 44 may be a mobile communication network. A user may perform a telephone call via the communication network 44. To the further phone 45. The processor 38 generates an audio signal from audio input at the microphone 30 and transmits the audio signal via the sender/receiver 36 into the communication network 44, which transmits it to the further phone 45. An audio signal from the further phone 45 may be received by the second sender/receiver 36 and/or may be output by the loudspeaker 32.

The proximity sensor 40 is adapted for determining, whether the hearing device 16 and the mobile device 14 are in proximity or not. For example, the proximity sensor 28 may comprise a magnetic sensor and/or magnetometer for sensing a magnetic field generated by the hearing device 16.

As will be described below, proximity also may be determined based on the signal strength of a radio signal of the radio transmission link 26 received by the sender/receiver 24 (or 34) and/or sent by the sender/receiver 24 (or 34).

Figure 2:
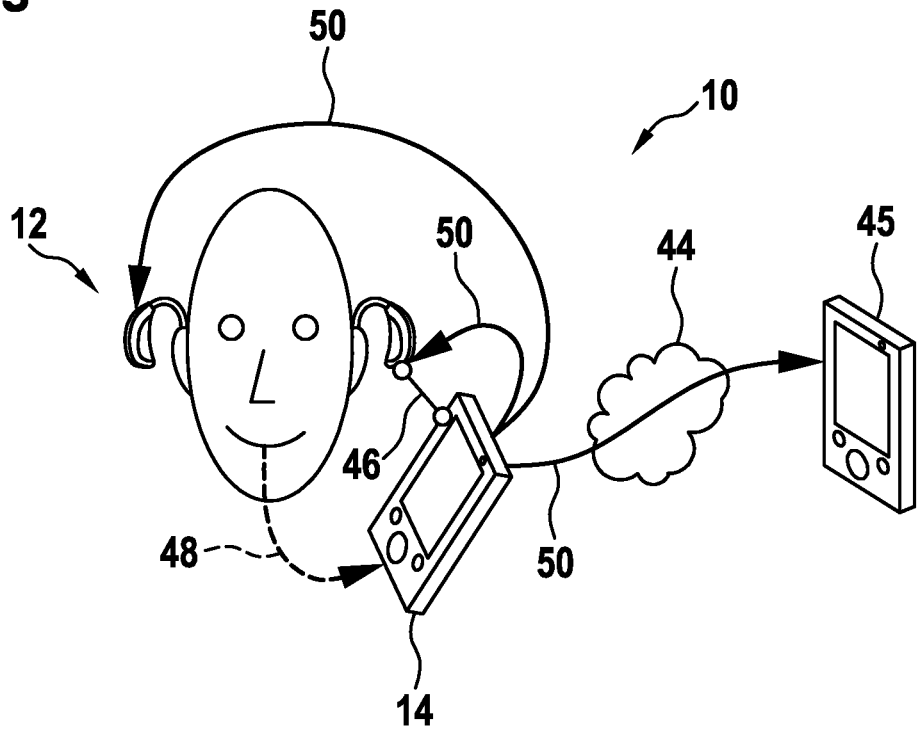
FIG. 2 schematically shows a hearing system according to a further embodiment of the disclosed technology.

FIG. 2 shows a first operation mode of the hearing system 10, which comprises two hearing devices 16. The first operation mode may be established, when proximity between at least one of the hearing devices 16 and the mobile device is detected. Proximity may be detected with the sensor 28, the sensor 40 and/or one or both of the sender/receivers 24, 34. In general, a signal from the sensor 28, 40, 24, 34 may depend on a distance 46 between the respective hearing device 16 and the mobile device. When the signal strength is higher than a threshold, it may be assumed that the hearing device 16 and the mobile device 14 are in proximity.

In the first operation mode, audio input 48 into the microphone 30 of the mobile device 14, such as the voice of a user of the hearing device 16, is converted into an audio signal 50, which may be sent to the hearing device 16 and in particular the hearing device 16. This may be done via the radio communication link 26 and/or with BLUETOOTH. The audio signal 50 also may be transmitted into the communication network 44 and from there to the further phone 45.

An audio signal from the communication network 44, for example from the further phone 45, may be added to the audio signal 50 and/or may be transmitted from the mobile device 14 to the hearing device 16.

Figure 3:
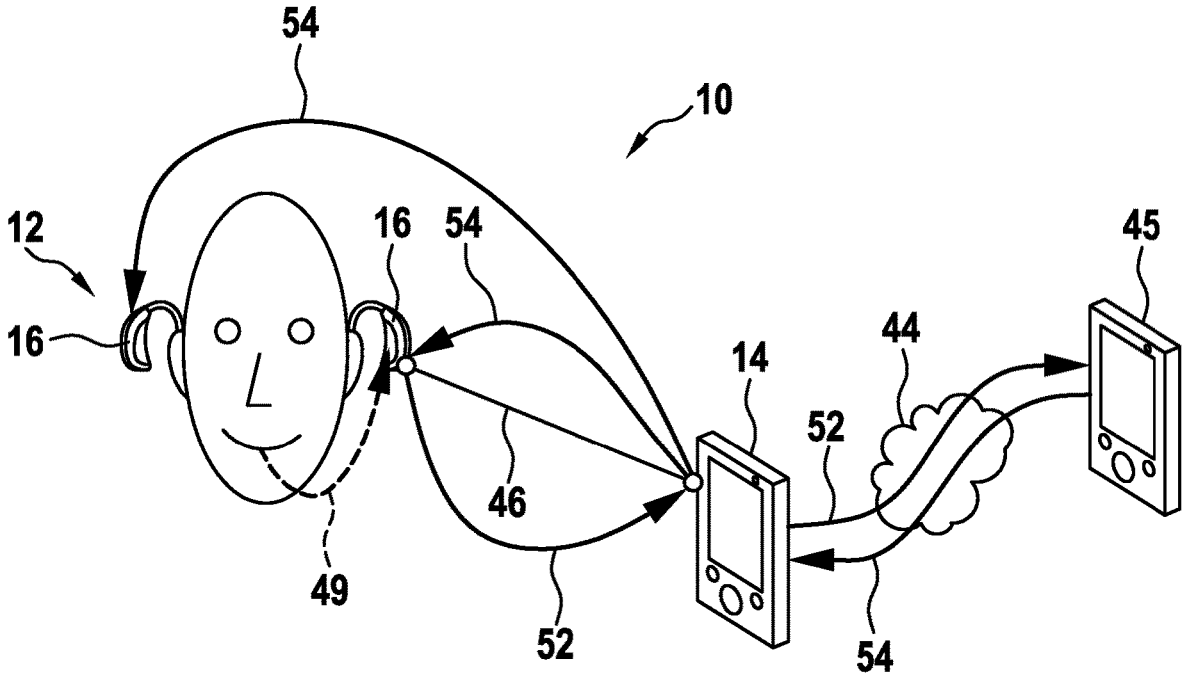
FIG. 3 schematically shows the hearing system of FIG. 2 in a further operation mode.

FIG. 3 shows a second operation mode of the hearing system 10, which second operation mode may be established, when proximity between at least one of the hearing devices 16 and the mobile device 14 is not detected.

In the second operation mode, audio input 49 into the microphone 20 of the hearing device 16 is converted into an audio signal 52, which is sent to the mobile device 14. This may be done via the radio communication link 26 and/or with BLUETOOTH. The audio input 49 may be the voice of the user, which is transmitted via the head of the user. In the case of FIG. 2, the voice of the user may be transmitted via air.

The audio signal 52 also may be transmitted into the communication network 44 and from there to the further phone 45. An audio signal 54 from the communication network 44 may be transmitted from the mobile device 14 to the hearing device 16 and in particular to the hearing devices 16.

Figure 4:
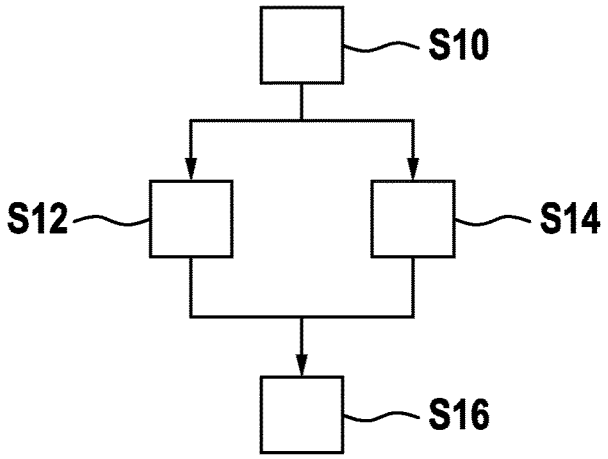
FIG. 4 shows a flow diagram for a method for selecting audio input from a microphone of a hearing device and a microphone of a mobile device according to an embodiment of the disclosed technology.

FIG. 4 shows a flow diagram for a method for selecting audio input 48, 49 from the microphone 20 of the hearing device 16 and the microphone 30 of the mobile device 14. The method may be automatically performed by the processor 23 and/or the processor 38.

In step S10, the hearing device 16 and/or the mobile device 14 detect, if the hearing device 16 and the mobile device are in proximity.

The proximity detection may be based on a signal of one of the sensors 34, 40 of the mobile device 14. As already mentioned, a proximity sensor 40 different from the sender/receiver 34 may be used. For example, the proximity sensor 40 may determine a magnetic field strength, which may be generated by the loudspeaker 22. It also may be that a signal strength or signal strength loss at the sender/receiver 34 is used for determining proximity. When a sensor 34, 40 of the mobile device 14 is used, the proximity determination may be performed by the mobile device 14.

Additionally or alternatively, the proximity detection may be based on a signal of a sensor 28, 24 of the hearing device. As already mentioned, a proximity sensor 28 different from the sender/receiver 24 may be used. For example, the proximity sensor 28 may determine a magnetic field strength, which may be generated by the loudspeaker 32 of the mobile device 14. It also may be that a signal strength or signal strength loss at the sender/receiver 24 is used for determining proximity. When a sensor 24, 28 of the hearing device 16 is used, the proximity detection may be performed by the hearing device 16.

In the case, one or both of the sender/receivers 24, 34 are used as proximity sensor, proximity detection may be performed with the signal strength of the radio transmission link 26. Such an RSSI (received signal strength indication) based solution may be implemented in the hearing device 16 and/or in the mobile device 14.

Proximity detection may be based on a received signal strength and/or a signal strength loss of the radio transmission link 26. The decision, whether the distance 46 is smaller than a threshold, may be determined by comparing the received signal strength and/or a signal strength loss with a threshold.

Distance estimation based on an absolute value of the received signal strength may be less exact as comparing relative signal strength values, because of the high variability of the received signal strengths, due to multipath fading, shadowing, etc. In addition, different mobile devices 14 may have different antenna gains and transmit powers. The antenna gain of a mobile device 14 typically may vary between 0 dBi and −2 dBi, and conducted transmission power may vary between 10 dBm and 17 dBm.

One possibility for proximity detection starts with controlling the transmit power and/or transmit signal strength of the mobile device 14. The transmit power and/or transmit signal strength by the mobile device 14 may be adapted to be within a desired power zone as requested by the hearing device 16.

After that, at the hearing device 16, the received power and/or the received signal strength may be measured, which has fixed transmit power and/or transmit signal strength at the mobile device 14. For example, the hearing device 16 may request the mobile device 14 to increase (for example step-wise) the transmit power and/or signal strength up to a maximal transmit power and/or maximal transmit signal strength. When the maximal transmit power and/or maximal transmit signal strength has been reached, this may be indicated by the mobile device 14 to the hearing device 16.

Proximity detection based on varying the transmit power and/or transmit signal strength may be performed with a BLUETOOTH classic profile on the hearing device 16, since in BLUETOOTH classic power control is possible.

From the current/actual received signal strength at the hearing device, a moving average may be determined. The decisions, whether the distance 46 is smaller than a threshold, may then be determined by comparing the moving average with a threshold.

For example, when a maximal transmit power and/or transmit signal strength is used, the hearing device 16 may perform a moving average of the received power and/or averaged received signal strength, and may decide that the mobile device 14 is at proximity if the averaged received power and/or averaged received signal strength is above the threshold.

A threshold for the proximity detection may be chosen in different ways.

For example, the threshold value may be selected to be fixed and the same for all types of mobile devices 14. This may have the advantage of being simple, but may be less exact than other methods.

Another possibility is to monitor a maximal received signal strength and to determine the threshold from this. For example, the maximal received power and/or maximal received signal strength may be automatically and continuously monitored. The threshold may be set at a fixed distance below this maximal received power and/or maximal received signal strength. A user may only have to hold the mobile device 14 at the ear to automatically calibrate the proximity detection threshold.

A further possibility may be that the hearing device 16 uses a list and/or table with phone models/types and thresholds, such that a calibration may not be necessary for mobile devices in the list/table. The threshold may be determined from a table stored in the hearing device 16 of thresholds with a type of the mobile device 14, wherein the table contains thresholds for a plurality of types of mobile devices.

In addition to the threshold crossing detection, the evolution over time of the averaged received signal strength may be evaluated to detect a movement of approaching the mobile device 14 to the ear.

A further possibility of proximity detection may be performed with the BLUETOOTH low energy profile. This may be performed by the hearing device 16. BLUETOOTH low energy does offer a profile for proximity detection. This proximity profile allows a "proximity monitor" (for example the hearing device 16) to read out the used transmit power and/or transmit signal strength by a "proximity reporter" (for example the mobile device 14). The proximity monitor can hence compute the path loss by subtracting the received power and/or received signal strength from the transmit power and/or transmit signal strength.

When the start of proximity or the end of proximity has been detected, the mobile device 14 and the hearing device 16 may have to dialog to change the operation mode, i.e. to switch between the first operation mode and the second operation mode as described with respect to FIGS. 2 and 3.

If proximity detection is performed by the mobile device 14, the operation mode change may be implemented with the BLUETOOTH hands-free profile (HFP). The mobile device 14 may route audio signals transmitted to the communication network 44, from the local microphone 30, when proximity is detected, or from the hearing device microphone 20, when proximity is not detected.

If proximity detection is performed by the hearing device 16, the operation mode change is signalled from the hearing device 16 to the mobile device 14. With BLUETOOTH classic, this signalling may be done via a proprietary command transmitted via the HFP profile control channel.

In the end, if the distance 46 is smaller than the threshold and/or proximity has been detected and the operation mode has been switched, the mobile device audio signal 50 is selected and the method proceeds in step S12. Otherwise, the hearing device audio signal 52 is selected and the method proceeds in step S14.

In step S12, as shown in FIG. 2, the audio input 48 is received with the microphone 30 of the mobile device 14 and the mobile device audio signal 50 is generated from the audio input 48 with the mobile device 14. The mobile device audio signal 50 is transmitted into the communication network 44 and/or to the further phone 45. Also, the mobile device audio signal 50 may be transmitted to the hearing device 16 via the radio transmission link 26, for example via BLUETOOTH.

In step S14, as shown in FIG. 3, the audio input 49 is received with the microphone(s) 20 of the hearing device 16 and/or the hearing devices 16 and a hearing device audio signal 52 is generated from the audio input 49 with the hearing device 16, for example one of the hearing devices 16. The hearing device audio signal 52 may be transmitted to the mobile device 14 via the radio transmission link 26, for example via BLUETOOTH and/or then may be transmitted into the communication network 44, where it may be forwarded to the far-end talker.

It also may be that a signal-to-noise ratio of the hearing device audio signal 52 is determined, for example either by the hearing device 16 or by the mobile device 14. It then may be that the decision, whether mobile device audio signal 50 should be selected or the hearing device audio signal should be selected is additionally based on this signal-to-noise ratio. If the signal-to-noise ratio of the hearing device audio signal 52 is smaller than a threshold, then although proximity is detected, the hearing device audio signal 52 may be selected.

When a signal-to-noise ratio of the hearing device audio signal 52 is determined, step S14 may be performed in parallel to step S10.

In step S16, the hearing device 16 may process the selected audio signal 50, 52 to compensate for a hearing deficiency of the user of the hearing device 16. In particular, the mobile device audio signal 50 may be processed in this way. It also may be that an audio signal, which is received by the mobile device 14 from the network 44 is added to the selected audio signal as side tone and processed in this way.

The selected and optionally processed audio signal 50, 52 may be output with the hearing device 16 to a user of the hearing device 16, for example via one or more loudspeakers 22.

While the disclosed technology has been illustrated and described in detail in the drawings and foregoing description, such illustration and description are to be considered illustrative or exemplary and not restrictive; the disclosed technology is not limited to the disclosed embodiments. Other variations to the disclosed embodiments can be understood and effected by those skilled in the art and practicing the claimed disclosed technology, from a study of the drawings, the disclosure, and the appended claims. In the claims, the word "comprising" does not exclude other elements or steps, and the indefinite article "a" or "an" does not exclude a plurality. A single processor or controller or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SYMBOLS

10 hearing system
12 pair of hearing devices
14 mobile device
16 hearing device
18 housing
20 microphone
22 loudspeaker
23 processor
24 sender/receiver
26 radio transmission link
28 proximity sensor
30 microphone
32 loudspeaker
34 first sender/receiver
36 sender/receiver
38 processor
40 proximity sensor
42 housing
44 communication network
45 further phone
46 distance
48 audio input
50 audio signal
52 audio signal
54 audio signal

The invention claimed is:

1. A method for selecting audio input from a microphone of a hearing device worn by a user or a microphone of a mobile device, the method comprising:

determining a signal-to-noise ratio of the audio input from the microphone of the mobile device;

detecting proximity between the hearing device and the mobile device;

if proximity between the hearing device and the mobile device is detected and the signal-to-noise ratio of the audio signal from the microphone of the mobile device is above a threshold:

receiving an audio input with the microphone of the mobile device and generating a mobile device audio signal from the audio input;

transmitting the mobile device audio signal from the mobile device into a communication network;

if proximity between the hearing device and the mobile device is not detected:

receiving an audio input with the microphone of the hearing device and generating the hearing device audio signal from the audio input with the hearing device;

transmitting the hearing device audio signal from the hearing device to the mobile device;

transmitting the hearing device audio signal from the mobile device into the communication network.

2. The method of claim 1, wherein proximity detection is based on a signal of a sensor of the mobile device and/or is performed by the mobile device.

3. The method of claim 1, wherein proximity detection is based on a signal of a sensor of the hearing device and/or is performed by the hearing device.

4. The method of claim 1, wherein the threshold is a first threshold;

wherein proximity between the hearing device and the mobile device is detected from a received signal strength and/or a signal strength loss of a radio transmission link between the mobile device and the hearing device, wherein the radio transmission link is used to transmit data and/or audio signals between the mobile device and the hearing device; and wherein proximity between the hearing device and the mobile device is detected by comparing the signal strength and/or signal strength loss with a second threshold.

5. The method of claim 4, wherein a current received signal strength is determined and a moving average is determined from the current received signal strength;

wherein proximity between the hearing device and the mobile device is detected by comparing the moving average with a third threshold.

6. The method of claim 4, wherein a maximal received signal strength is monitored and the second threshold is determined from the maximal received signal strength.

7. The method of claim 4, wherein the second threshold is determined from a table of thresholds with a type of the mobile device, wherein the table contains thresholds for a plurality of types of mobile devices.

8. The method of claim 7, further comprising: determining a signal-to-noise ratio of the hearing device audio signal; wherein the mobile device audio signal is selected, if proximity is detected and the signal-to-noise ratio of the hearing device audio signal is smaller than a fourth threshold.

9. The method of claim 8, wherein the user has two hearing devices and each hearing device has a microphone;

wherein the hearing device audio signal is generated from an audio input of the microphones of the hearing devices.

10. The method of claim 9, further comprising:

outputting the selected audio signal with the hearing device to a user of the hearing device.

11. The method of claim 10, further comprising:

processing the selected audio signal by the hearing device to compensate for a hearing deficiency of the user of the hearing device.

12. The method of claim 11, further comprising:

transmitting the mobile device audio signal to the hearing device via a radio transmission link; and/or transmitting the hearing device audio signal to the mobile device via a radio transmission link.

13. A non-transitory computer-readable medium storing instructions, which when executed by a processor, cause a device or devices to perform operations for selecting a microphone, the operations comprising:

determining a signal-to-noise ratio of an audio input from a microphone of a mobile device;

detecting proximity between a hearing device and the mobile device;

if proximity between the hearing device and the mobile device is detected and the signal-to-noise ratio of the audio signal from the microphone of the mobile device is above a threshold:

receiving an audio input with the microphone of the mobile device and generating a mobile device audio signal from the audio input;

transmitting the mobile device audio signal from the mobile device into a communication network;

if proximity between the hearing device and the mobile device is not detected:

receiving an audio input with the microphone of the hearing device and generating the hearing device audio signal from the audio input with the hearing device;

transmitting the hearing device audio signal from the hearing device to the mobile device;

transmitting the hearing device audio signal from the mobile device into the communication network.

14. The non-transitory computer-readable medium of claim 13, wherein proximity detection is based on a signal of a sensor of the mobile device and/or is performed by the mobile device.

15. The non-transitory computer-readable medium of claim 13, wherein proximity detection is based a signal of a sensor of the hearing device and/or is performed by the hearing device.

16. The non-transitory computer-readable medium of claim 13, wherein the threshold is a first threshold, wherein proximity between the hearing device and the mobile device is detected from a received signal strength and/or a signal strength loss of a radio transmission link between the mobile device and the hearing device, wherein the radio transmission link is used to transmit data and/or audio signals between the mobile device and the hearing device; wherein proximity between the hearing device and the mobile device is detected by comparing the signal strength and/or signal strength loss with a second threshold.

17. A hearing device, the hearing device comprising:

a battery, a microphone, a processor, a memory electronically coupled to the processor, wherein the memory includes instructions, and wherein instructions include operations, the operations comprising:

determine a signal-to-noise ratio of an audio input from a microphone of a mobile device;

determine whether the hearing device and a mobile device are within a proximity threshold;

if within the proximity threshold and the signal-to-noise ratio of the audio signal from the microphone of the mobile device is above a threshold:

receive an audio input with the microphone of the mobile device and generating a mobile device audio signal from the audio input;

transmitting the mobile device audio signal from the mobile device into a communication network;

if outside the proximity threshold:

receive an audio input with the microphone of the hearing device and generating the hearing device audio signal from the audio input with the hearing device;

transmit the hearing device audio signal from the hearing device to the mobile device; and transmit the hearing device audio signal from the mobile device into the communication network.

18. The hearing device of claim 17, wherein proximity between the hearing device and the mobile device is detected from a received signal strength and/or a signal strength loss of a radio transmission link between the mobile device and the hearing device, wherein the radio transmission link is used to transmit data and/or audio signals between the mobile device and the hearing device.

19. The hearing device of claim 17, wherein the threshold is a first threshold, and wherein proximity between the hearing device and the mobile device is detected by comparing the signal strength and/or signal strength loss with a second threshold.

* * * * *